United States Patent [19]

Colle et al.

[11] 4,026,246

[45] May 31, 1977

[54] BOILER FOR CENTRAL HEATING INSTALLATIONS AND HEAT EXCHANGE ELEMENTS FOR SAID BOILER

[75] Inventors: Augusto Colle, Milan, Italy; James Fisher, Gland, Switzerland, 4

[73] Assignee: American Standard, Inc., New York, N.Y.

[22] Filed: Mar. 5, 1975

[21] Appl. No.: 555,652

[52] U.S. Cl. ..... 122/225 R; 122/210

[51] Int. Cl.[2] ..... F22B 23/00

[58] Field of Search ..... 122/210, 223, 224, 225 R, 122/228, 229

[56] References Cited

UNITED STATES PATENTS

| | | | |
|---|---|---|---|
| 2,316,603 | 4/1943 | Livar | 122/225 |
| 2,934,046 | 4/1960 | Donohue | 122/225 |
| 3,366,092 | 1/1968 | Bove | 122/225 |
| 3,533,379 | 10/1970 | Martin et al. | 122/225 |

*Primary Examiner*—Kenneth W. Sprague
*Attorney, Agent, or Firm*—James J. Salerno, Jr.; Robert G. Crooks

[57] ABSTRACT

A wet base boiler of the multi-sectioned type, that is, a boiler in which the fire box is surrounded by water. Each heat exchanger section of the boiler being arranged and constructed to provide an improved heat transfer surface when contacted by the heated gases emanating from the fire box. The heat transfer surface of each section comprises opposing parallel walls having a plurality of equispaced ribs disposed thereon to define a curvilinear path between adjacent ribs, the ribs formed on one wall of a heat exchanger section being antisymmetrical with the ribs formed on the opposing wall of the heat exchanger section, each rib of each wall having spaced fins or cusps and each fin or cusp having a height so as to be spaced from the fins branching from the ribs of an adjacent heat exchanger section.

3 Claims, 6 Drawing Figures

BOILER FOR CENTRAL HEATING INSTALLATIONS AND HEAT EXCHANGE ELEMENTS FOR SAID BOILER

Boilers generally used in central heating installations notably consist of a series of heat exchange elements which are mounted adjacent to each other and are arranged to define an inlet header for the water to be heated, an outlet header for the heated water, a series of chambers located between said headers for the flow of the water, a series of ducts of mainly vertical extension through which the hot combustion products are channelled, and a chamber containing the burners.

The efficiency of burners of this type depend largely on the configuration of each individual heat exchange element, and the configuration of the chambers, cavities and ducts which are created by coupling together adjacent heat exchange elements.

Heat transfer between the hot gas and its surfaces depends largely both on the velocity of said gas and on the time for which the gas is in contact with said surfaces.

More precisely the heat transfer coefficient between a stream of hot gas and a surface depends, amongst other things, on the conditions of motion of the stream in the vicintiy of the surface. Optimum heat transfer conditions are obtained when the stream which laps the surface is in a state of turbulent motion, whereas the heat transfer coefficient falls sharply when the motion becomes laminar.

Moreover when a fluid stream accelerates, turbulent motion conditions tend to form, while when the stream decelerates laminar motion conditions can arise. However, conditions of excessive turbulence are undesirable because of the excessive pressure drops which they imply.

At present, in constructing heat exchange elements and in defining their outer configuration which partially determines the flow ducts for the hot gas, two partially contradictory tendencies are substantially followed. These comprise slowing down the hot gas flow by providing the outer surfaces of the heat exchange elements with appendices or protuberances which generate a convenient turbulence in the gas in order to check the stream and increase its time of contact with the heat exchanger surface, and in addition increasing as much as possible the speed of the hot gas stream, especially at the outlet of the exchanger, where otherwise because of its partial cooling it would tend to slow down and lead to the possibility of laminar flow conditions which sharply reduce the heat transfer coefficient.

Optimum conditions would arise where the flow produced is characterized by turbulence conditions just beyond the limits of laminar flow, so that its velocity is maintained within acceptable limits with regard to pressure drops.

In all known exchangers however, the aforementioned opposing requirements of long times of contact between the gas and the exchangers together with turbulent flow which implies high gas speed, are hardly reconcilable to the detriment of the overall boiler efficiency.

In known exchangers, the formation of a continuous limiting layer adjacent to the surfaces lapped by the gas is a common phenomenon, in spite of the average turbulent motion, which gravely prejudices the heat transfer coefficient.

The present invention provides a type of heat transfer element for forming a boiler of the aforementioned type, in which the two outer parallel surfaces are configured in such a manner that, when facing the identical walls of adjacent elements, they create a duct in which the hot gas stream is divided into three ideal layers, of which the two layers adjacent to the elements themselves are characterized by a motion which is just turbulent and implying low pressure drops, while the intermediate layer is characterized by high turbulence which without interferring with the characteristics of the motion of the layers which lap the elements, checks their speed as much as possible, so increasing the contact time between the gas and the exchanger.

The invention also contemplates providing a novel boiler construction having a plurality of coupled heat exchanger sections to be filled with water, each section including two side legs, a basal leg fluidically interconnecting the bottoms of the side legs and a compartment segment fluidically connected to the tops of said side legs. A fire box is bounded by the side legs, basal legs of the compartment segments so that the heat emanating from the fire box is directly applied to the side legs, basal legs and the compartment segments. The compartment segments of each heat exchanger section is defined by opposing parallel walls, each wall having a plurality of equispaced ribs disposed thereon to define a curvilinear path between adjacent ribs, the ribs formed on one of the parallel walls being antisymnetrical with the ribs formed on the other parallel wall and each rib of each wall having spaced fins or cusps. Each fin or cusp is so formed as to have a height which will maintain a space between the fins branching from the ribs of an adjacent heat exchanger section.

The object of the invention is thus to provide heat exchange elements which, when coupled together, form passage chambers for the hot gas in which the gas is present in different conditions of motion, the gas having a limited flow velocity so as to keep pressure drops low and increase its contact time with the exchanger, while being in a condition of turbulent motion adjacent to the walls.

A further and not less important object of the invention is to provide elements which when coupled together create flow chambers for the hot gas which are easily accessible for cleaning operations.

This is attained according to the invention, by providing each of the two lateral parallel outer surfaces of each heat exchange element with a series of parallel ribs of serpentine form, said ribs comprising at their summit a series of equidistant appendices of constant height which follow the configuration of the ribs.

According to the invention the sinusoidal development of the ribs on one face is antisymmetrical with respect to the sinusoidal development of the ribs on the opposite parallel face of the same exchanger element, and therefore also anti-symmetrical with the adjacent element.

When the elements are place one facing the other to form the boiler, the appendices projecting from the face of one element and those projecting from the face of the adjacent element do not copenetrate, and moreover said appendices are mutually offset and antisymmetrically orientated so creating a type of crossed flow of the heating fluid which passes in the central zone between the elements.

It is evident that the zone of greatest turbulence is limited to the central space between the two elements, and only partly affects the two zones immediately adjacent to the elements in which the gas flow is guided continuously by the ribs existing there which create a turbulence involving the limiting gas layer in contact with the wall of the element, so increasing its heat exchange without however producing an excessive pressure drop.

The sinusoidal configuration of the ribs is such as to greatly lengthen the path traversed by the gas, so maintaining its time of contact with the elements sufficiently high in spite of its velocity, which is sufficient to prevent the formation of laminar motion.

The functional and constructional merits and characteristics of the invention will be more evident from the detailed description given hereinafter, referring to the figures of the accompanying drawings which illustrate one possible preferred embodiment given by way of non-limiting example.

DESCRIPTION OF THE PREFERRED EMBODIMENT

Figure 1:
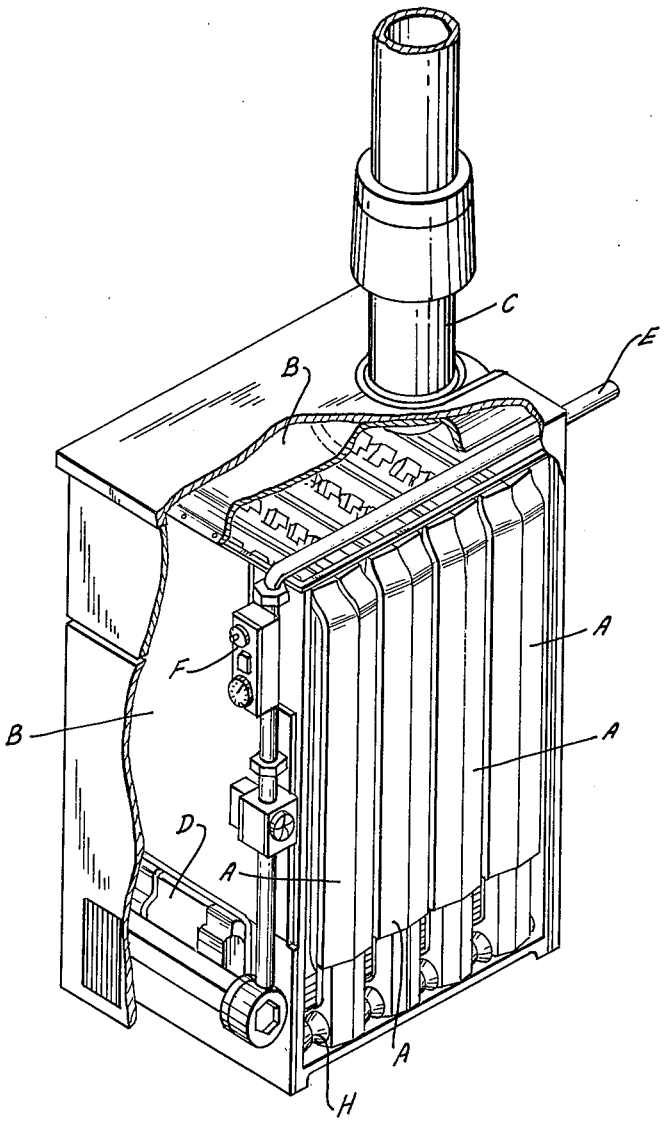
FIG. 1 shows a partially sectional perspective view of a boiler of the type to which the invention refers.

From FIG. 1 it can be seen that the boiler according to the invention consists of a plurality of adjacent heat exchange elements A enclosed in a suitable external housing B from which the draught stack C branches and which at its front end supports the burner unit D. The unit D is housed in a chamber consisting of a series of coaxial cavities formed in each of the elements A. The Figure also shows the gas feed duct E, the control device F located at the front of the boiler, and the water feed header H. The water discharge header is not visible in the figure.

From FIGS. 2 to 6 it can be seen that each of the elements A, to which the invention particularly refers, consists of a substantially annular chamber of quadrangular plan 1, the upper horizontal portion of which has an inner cross section which is much greater than any of the portions of the ring. Said annular chamber 1 defines internally an empty space 3 which, together with the analogous spaces of the adjacent chambers, creates a substantially parallelpiped compartment in which the burner is hoursed. The two opposite vertices of the annular chamber comprise two bosses 4 and 5 which, when coupled to the bosses of the adjacent heat exchange elements, define the cold water inlet header and the hot water outlet header respectively.

The two major parallel opposite walls of the upper portion 2 of greater cross section each comprise a series of ribs of substantially sinusoidal development. The ribs 6 present on one wall are antisymmetrical with respect to the ribs 66 present on the opposite wall. The sinusoidal ribs 6 on one wall of the element A are substantially in phase opposition to the ribs 66 on the opposite wall. Said ribs 6 and 66 extend vertically over the entire height of the portion 2 of greater cross section, and are characterized in that along their path they comprise projecting cusps or fins, 7 and 77 respectively, which are substantially equidistant. Said projecting cusps of fins 7 and 77 are all of constant height and are present over the entire extension of the ribs 6 and 66.

When two elements A and A' are placed facing each other, a chamber is created between one element and the adjacent element which, because of the phase opposition of the sinusoidal development of the ribs 6 and 66 and cusps 7 and 77, defines the substantially vertical passage for the hot combustion products, and which is divided into three zones (see FIGS. 3 and 4):

- a zone of parallel channels of sinusoidal development adjacent to the element A, defined by the ribs 6;
- a zone of parallel channels of sinusoidal development antisymmetrical to the former, adjacent to the element A' and defined by the ribs 66;
- a central zone in which the cusps 7 and 77, mutually oriented antisymmetrically opposite directions, face each other.

The ascending motion of said combustion products is therefore characterized by two zones of very modest turbulence which are substantially tangential to the two opposing elements which defines the aforementioned duct, these zones extending between the aforesaid ribs 6 and 66, and a central zone of greater turbulence associated with the fins or cusps 7 and 77. Because said fins or cusps 7 and 77 are orientated in opposite directions to the fins or cusps on the other wall as a result of the phase differences between the development of the ribs 66 of the opposing element, they create a turbulent cross motion which leads to a continuous interchange of hot gas between the central zone and the most inner layer of the two zones of limited turbulence adjacent to the heat exchange elements.

Figure 2:
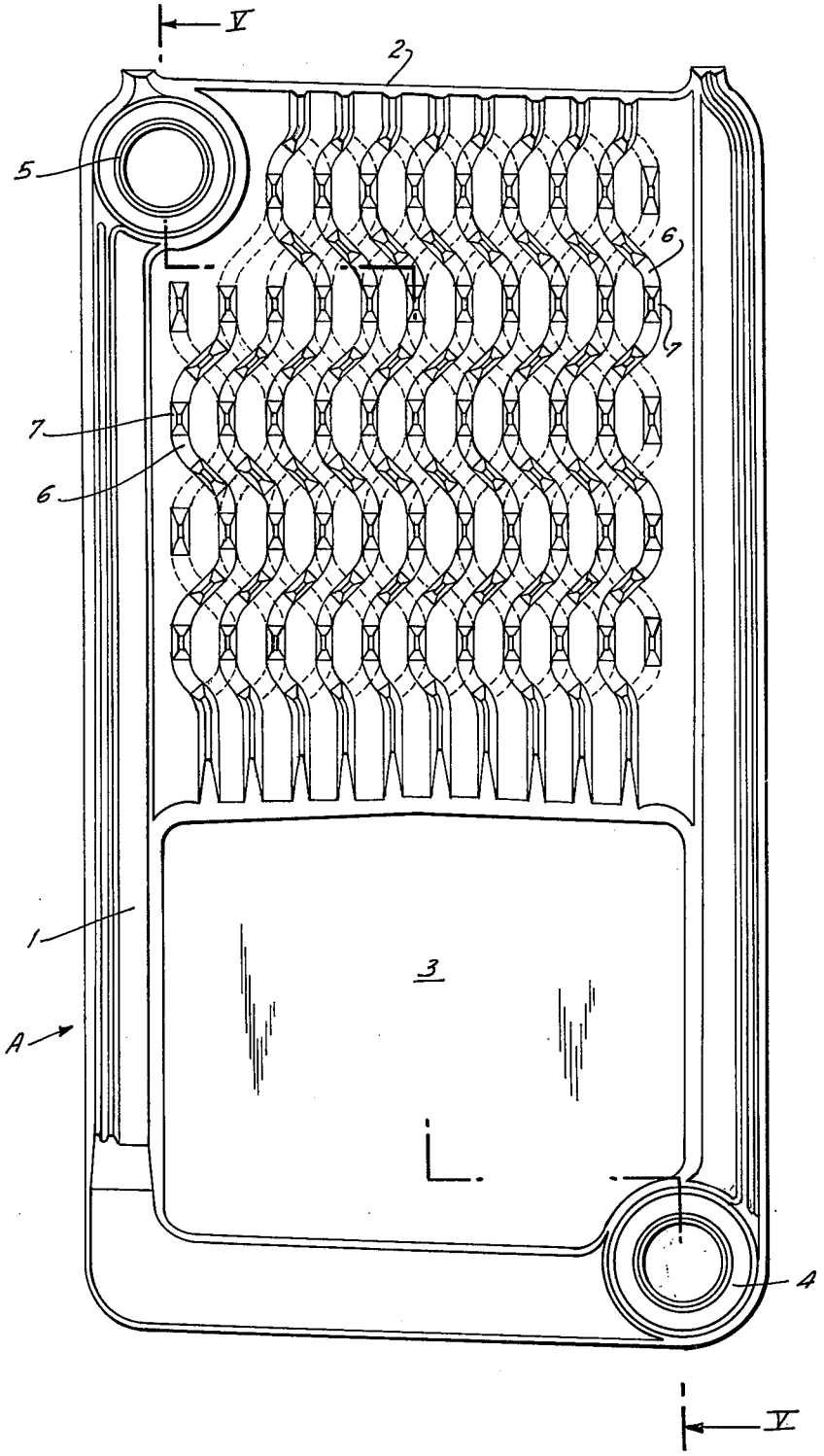
FIG. 2 is a frontal view of the heat exchange element, the dashed lines indicating the projections on its rear face.
Figure 3:
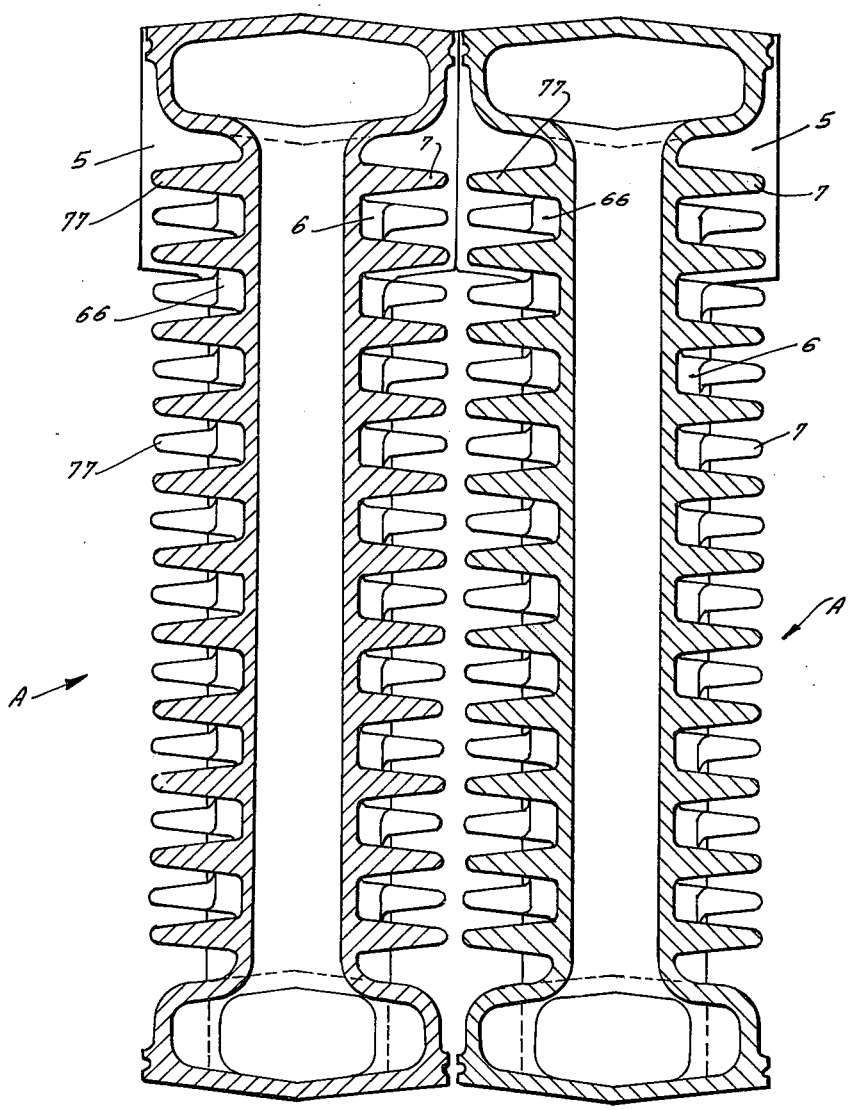
FIG. 3 is a horizontal section through two heat exchange elements coupled together, on the line III—III of FIG. 5.
Figure 4:
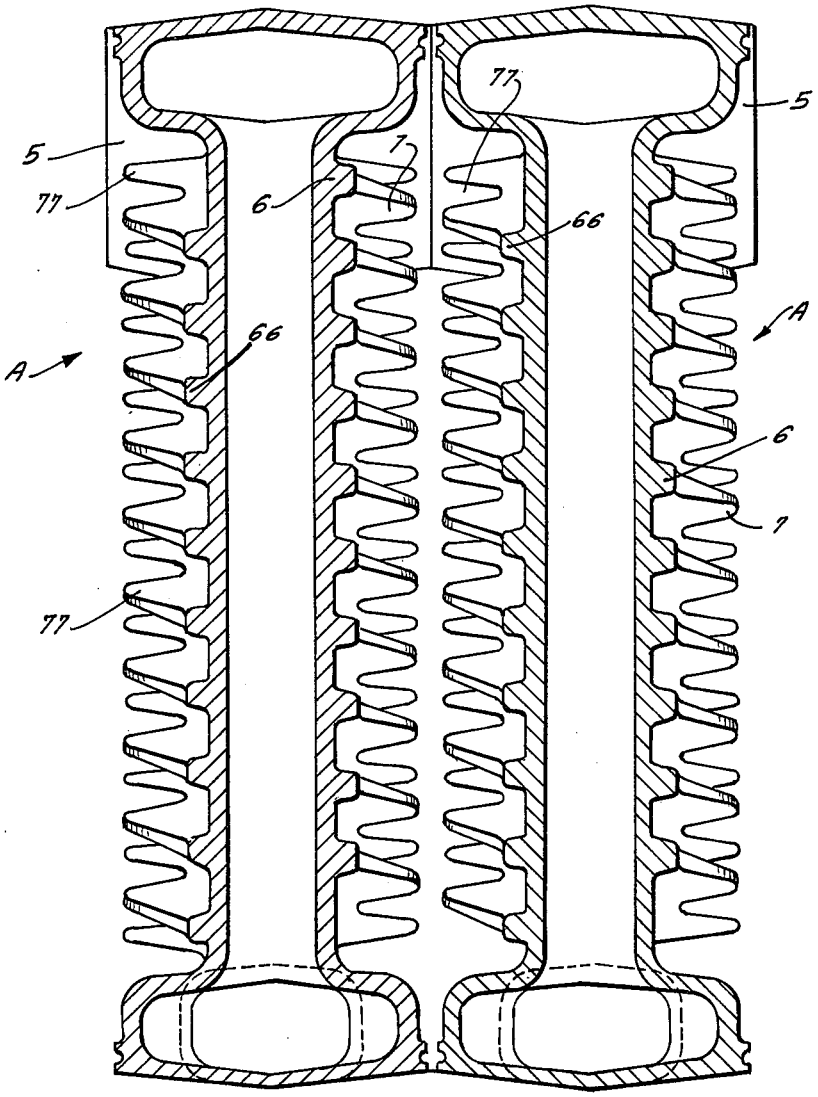
FIG. 4 is a horizontal section through two coupled heat exchange elements, on the line IV—IV of FIG. 5.
Figure 5:
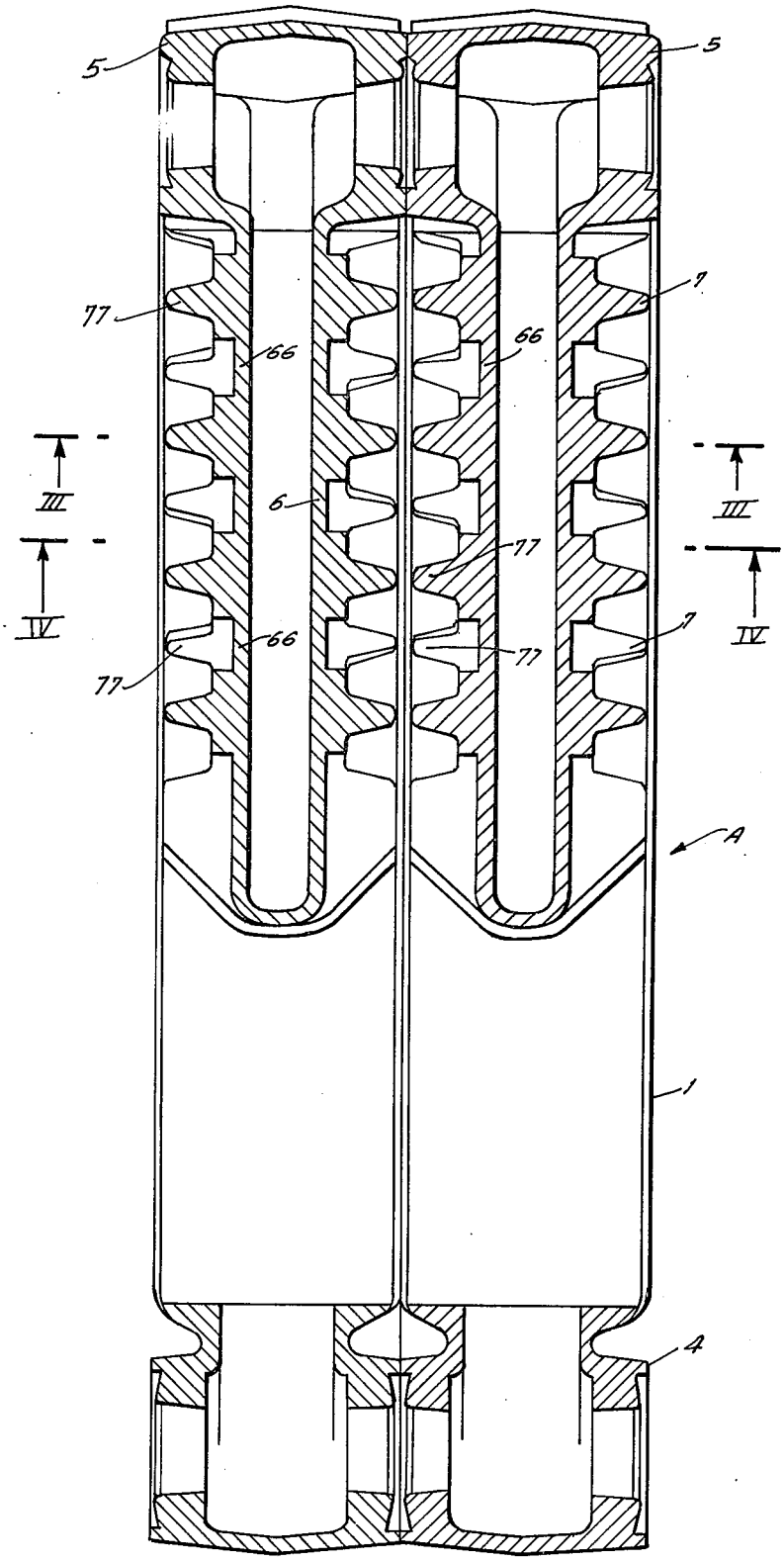
FIG. 5 is a vertical section through two elements coupled together to form the boiler, on the line V—V of FIG. 2.
Figure 6:
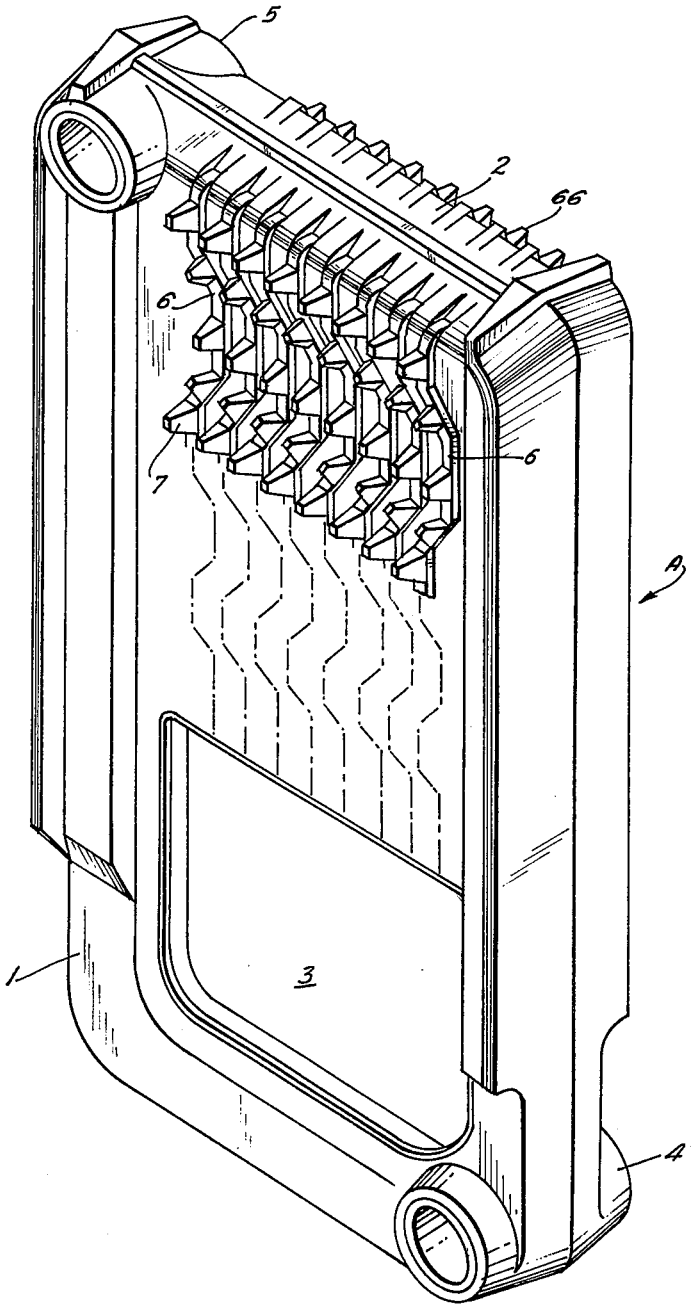
FIG. 6 is a perspective view of one of the heat exchange elements which form said boiler.

Finally, the boiler may be easily cleaned by inserting a brush diagonally between one element and the other as shown in FIG. 2.

The invention is not limited to the single embodiment heretofore described and variations and improvements may be made to it without leaving the scope of the invention, the fundamental characteristics of which are summarized in the following claims. 9n

What is claimed is:

1. A boiler consisting of a plurality of coupled heat exchanger sections to be filled with water, each section including two side legs, a basal leg fluidically interconnecting the bottoms of the side legs and a compartment segment fluidically connected to the tops of said side legs, a fire box bounded by said side legs, basal legs and said compartment segments, the heat emanating from the fire box being directly applied to said side legs, basal legs and said compartment segments, and said compartments of each heat exchanger section being defined by two parallel walls, each wall having a plurality of equispaced outwardly projecting ribs disposed thereon to define a curvilinear path between adjacent ribs, the ribs formed on said one wall being antisymmetrical with the ribs formed on the other wall of said compartment segment and each rib of each wall having spaced fins or cusps and each fin or cusp having a height so as to be spaced from the fins branching from the ribs of an adjacent heat exchanger section.

2. The boiler of claim 1 wherein the opposing walls of adjacent heat exchanger sections are arranged and constructed to form a duct for transfer of heat from the hot gas emanating from the fire box, each wall having a plurality of equispaced ribs disposed thereon to define a curvilinear path between adjacent ribs, the ribs formed on one wall being antisymmetrical with the ribs formed on the opposite wall of the adjacent heat exchanger section and each rib of each wall having spaced fins or cusps and each fin or cusp having a height so as to be spaced from the fins branching from the opposing wall of the adjacent heat exchanger section.

3. The boiler of claim 1 wherein the heat exchanger section is shaped in the form of a toroidal irregular body of constant thickness and quadrangular plan comprising at two opposing vertices two bosses which, in combination with the bosses of the adjacent sections, define the water inlet and outlet headers, and having one side of much greater cross section than the cross section of the other three sides, on the opposing sides of which there are parallel sinusoidal ribs from which project equidistant cusps or fins.

* * * * *